US010893991B1

(12) United States Patent
Lara et al.

(10) Patent No.: US 10,893,991 B1
(45) Date of Patent: Jan. 19, 2021

(54) CHAIR WITH EXTENDABLE FOOTREST

(71) Applicants: Carlos Lara, Landing, NJ (US); James Giacomaro, Mine Hill Township, NJ (US)

(72) Inventors: Carlos Lara, Landing, NJ (US); James Giacomaro, Mine Hill Township, NJ (US)

( * ) Notice: Subject to any disclaimer, the term of this patent is extended or adjusted under 35 U.S.C. 154(b) by 186 days.

(21) Appl. No.: 16/127,368

(22) Filed: Sep. 11, 2018

(51) Int. Cl.
*A61G 5/12* (2006.01)
*A47C 7/50* (2006.01)
*A47C 1/034* (2006.01)

(52) U.S. Cl.
CPC ..... *A61G 5/128* (2016.11); *A47C 1/034* (2013.01); *A47C 7/5064* (2018.08)

(58) Field of Classification Search
CPC ..... A61G 5/128; A47C 7/5064; A47C 1/034
See application file for complete search history.

(56) References Cited

U.S. PATENT DOCUMENTS 917,184 A * 4/1909 Tate ..... A47C 7/506 297/423.2
1,277,886 A * 9/1918 Elliman ..... A47C 7/506 297/423.2
3,295,885 A * 1/1967 Barksdale ..... A47C 3/025 297/84
3,794,381 A * 2/1974 Caldemeyer ..... A47C 7/506 297/423.22
3,869,169 A 3/1975 Johnson
5,277,477 A * 1/1994 Sharff ..... A61G 5/12 297/313
5,312,161 A * 5/1994 Mars ..... A47C 7/506 297/423.2
6,948,777 B2 * 9/2005 Marshall ..... A47C 7/52 297/423.2
7,547,072 B1 * 6/2009 Delmestri ..... A47C 7/506 297/423.21
7,621,599 B2 * 11/2009 Whalen ..... A47C 7/50 297/423.21
2006/0284463 A1 12/2006 Gelo

* cited by examiner

*Primary Examiner* — Kevin Hurley
*Assistant Examiner* — Michael R Stabley
(74) *Attorney, Agent, or Firm* — Sanchelima & Associates, P.A.; Christian Sanchelima; Jesus Sanchelima

(57) ABSTRACT

The present invention is a chair having a footrest that is extended when in use and retracted when not in use, have more space for comfortably positioning feet of a user/patient having more weight and is stable to provide safety. Chair includes a pair of leg frames, a pair of brackets, at least a pair of rollers, a footrest, at least one lever, gliding pins and wheels. Brackets are defined with railings and positioned on leg frames of chair. Rollers are connected to footrest and positioned to roll along the length of railing thereby enabling footrest to extend and retract. Footrest is of a size such that it is completely positioned between legs of chair to provide more feet resting area. Wheels are positioned underneath footrest for easy movement. Gliding pins connect wheels and footrest. Lever limits footrest movements and enables manipulating footrest with an extended handle.

7 Claims, 4 Drawing Sheets

CHAIR WITH EXTENDABLE FOOTREST

BACKGROUND OF THE INVENTION

1. Field of the Invention

The present disclosure relates to a chair. More particularly, the present disclosure relates to a chair with a footrest that is extendable, provides more space for resting feet of a user or a patient and is safe.

2. Description of the Related Art

A number of chairs are available however they are uncomfortable because of less or no space for positioning feet of either a user who is of more weight or a patient who has recently undergone knee or hip operations. Hence, there is a need for a chair having an extendable footrest with more space for comfortably positioning feet.

Several designs for chairs with footrests have been designed in the past. None of them, however, includes a chair having an extendable footrest that provides more space for comfortably positioning feet of a user or a patient undergone an operation and is safe.

Applicant believes that a related reference corresponds to a US granted patent 20060284463 filed by GOSO LLC for Moving seat chair for exercise rehabilitation. The GOSO reference discloses a chair that supports the weight of the user so that no unwanted load is added to the knee. However, the footrest provided is pushed to achieve swinging motion and may not render comfortably positioning of feet on footrest.

Another related application is U.S. Pat. No. 3,869,169 by Pontiac Furniture Industries INC for a retractable footrest mechanism. The patent '169 discloses an extensible and retractable footrest for reclining chairs. However, the extensible and retractable footrest disclosed in the reference '169 may not be usable for user with more weight requiring more footrest space.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a chair having a footrest that can be extended when in use and retracted when not in use.

It is yet another object of the present invention to provide a chair having an extendable footrest that provides more surface area to properly position feet of a user or a patient especially having more weight.

It is still another object of the present subject matter to provide a chair having an extendable footrest that is more stable and hence safe.

It is still another object of the present subject matter to provide a chair having a footrest that is easily extendable by rollers disposed on either side of footrest and rolling within respective railings of respective brackets disposed on a pair of leg frames of chair and underneath a handle portion.

It is still another object of the present subject matter to provide a chair having a footrest that has wheels disposed underneath of footrest to support footrest and provide easy movement to various places.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 4 illustrates a closer view of bracket 30 and footrest 50 and connection there between.

DETAILED DESCRIPTION OF THE EMBODIMENTS OF THE INVENTION

Figure 1:
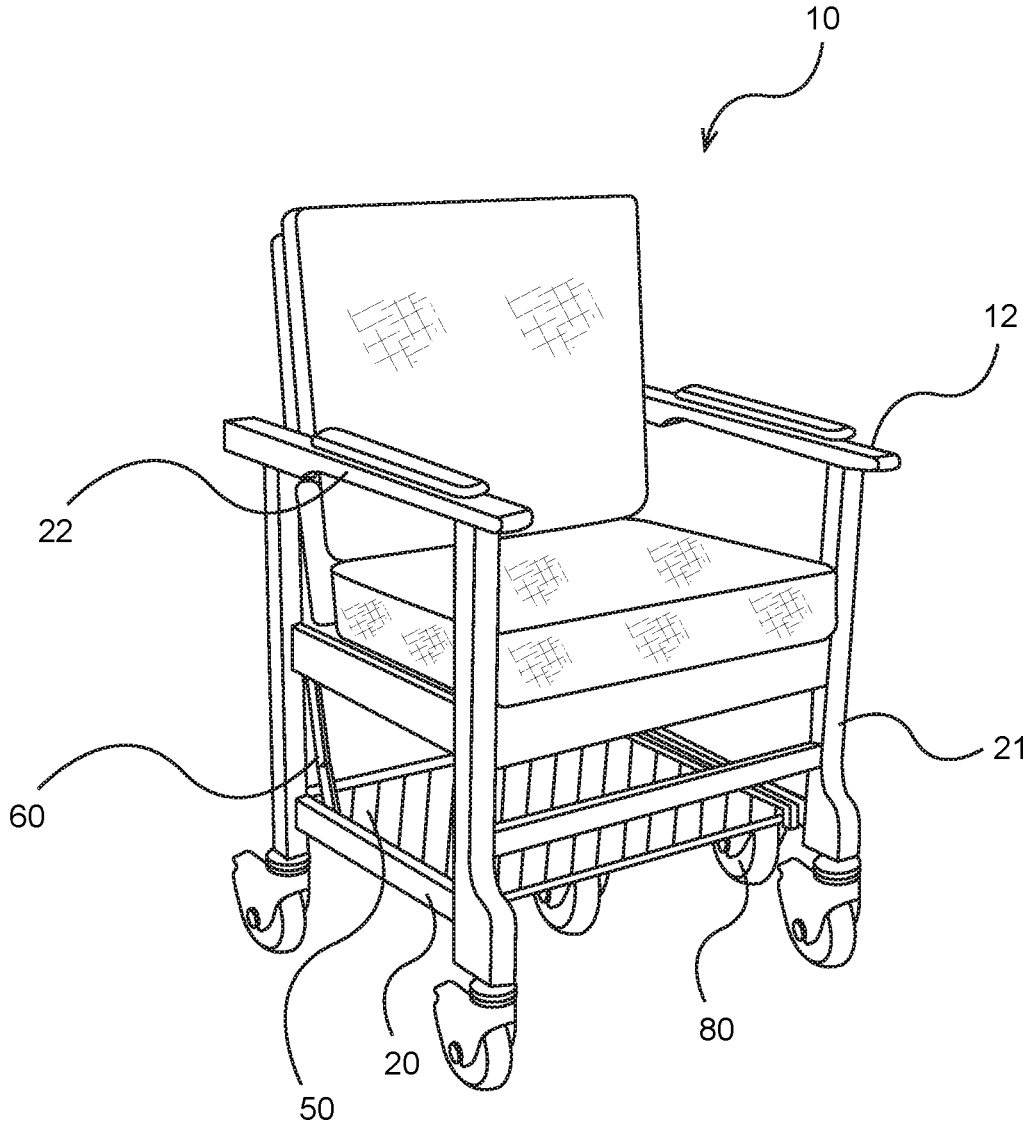
FIG. 1 represents an isometric view of a chair 10 with a footrest 50 in retracted configuration.
Figure 2:
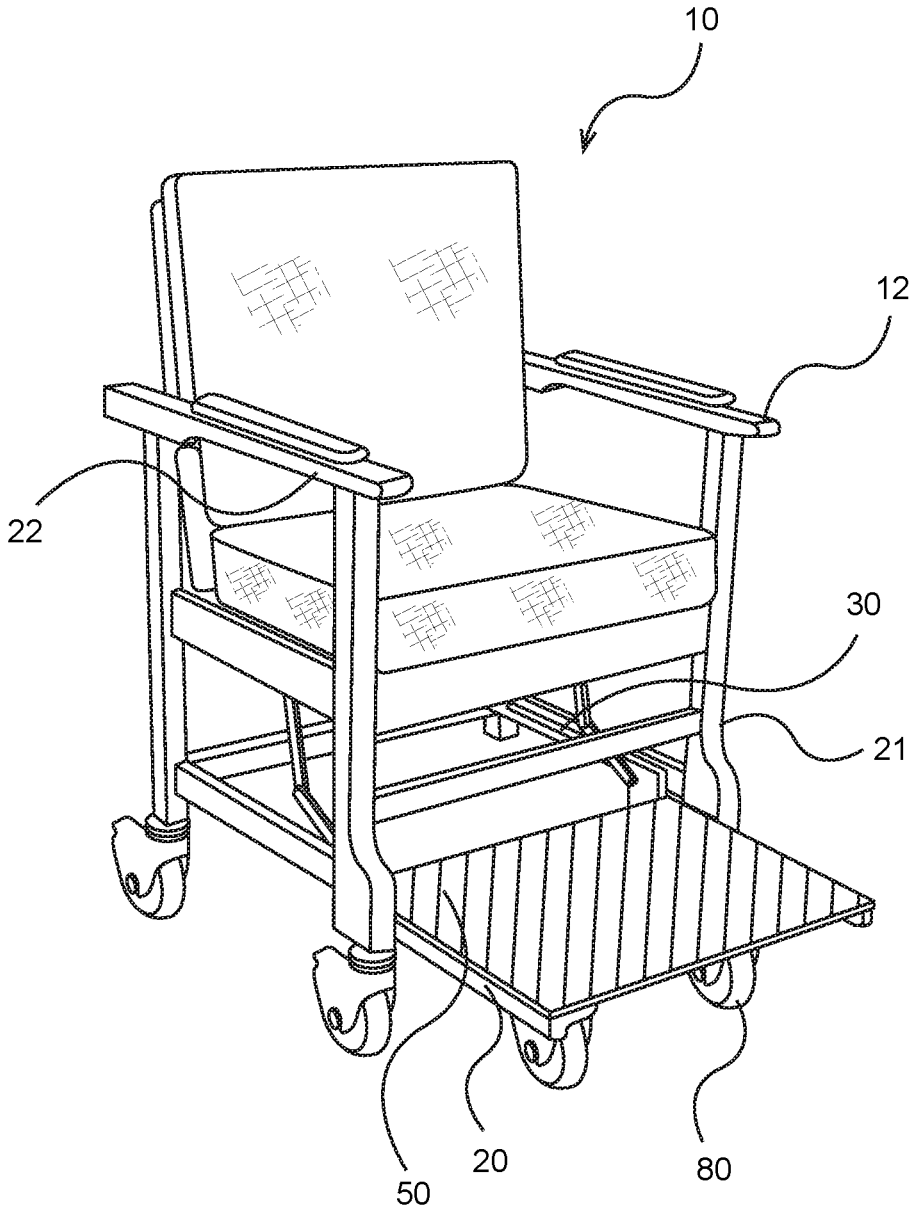
FIG. 2 represents an isometric view of chair 10 of FIG. 1, wherein footrest 50 is in an extended configuration.
Figure 3:
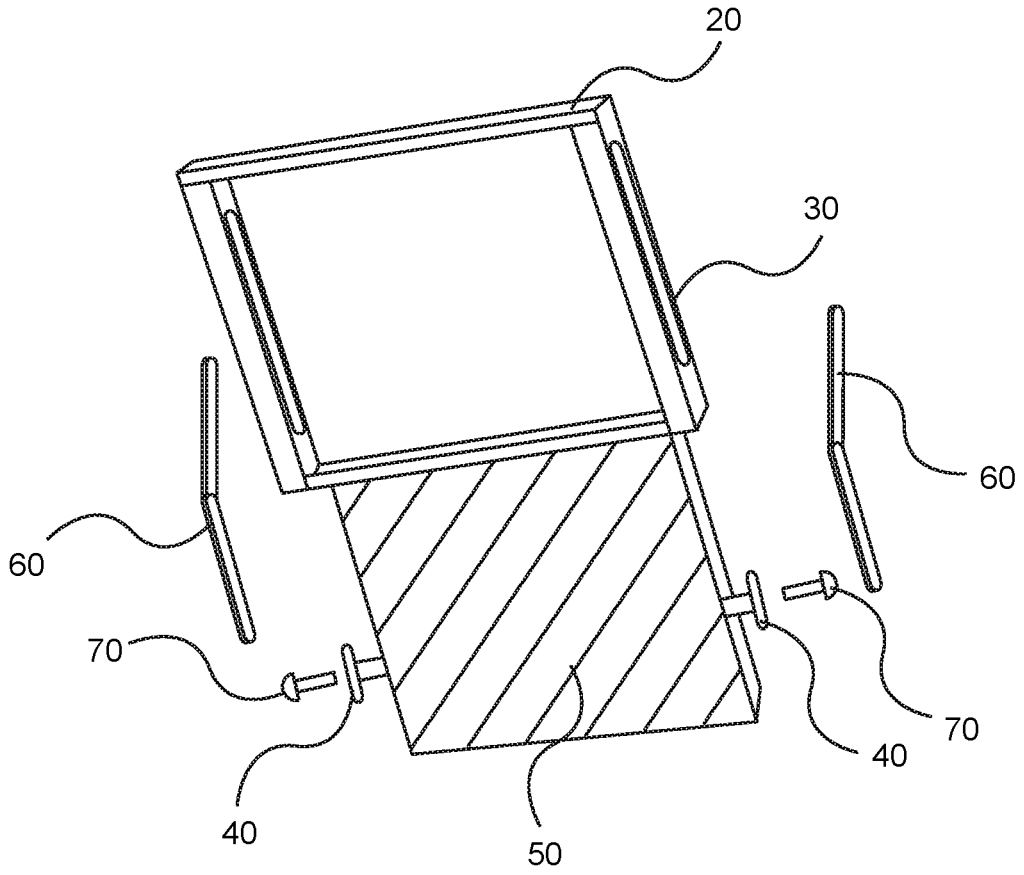
FIG. 3 shows an exploded view of bottom portion of chair 10 depicting leg frames 20, brackets 30, rollers 40, footrest 50 and levers 60.
Figure 4:
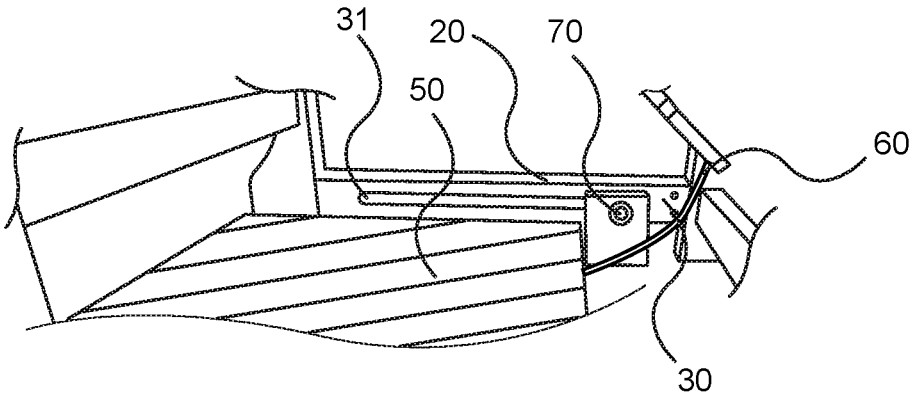
Figure 5:
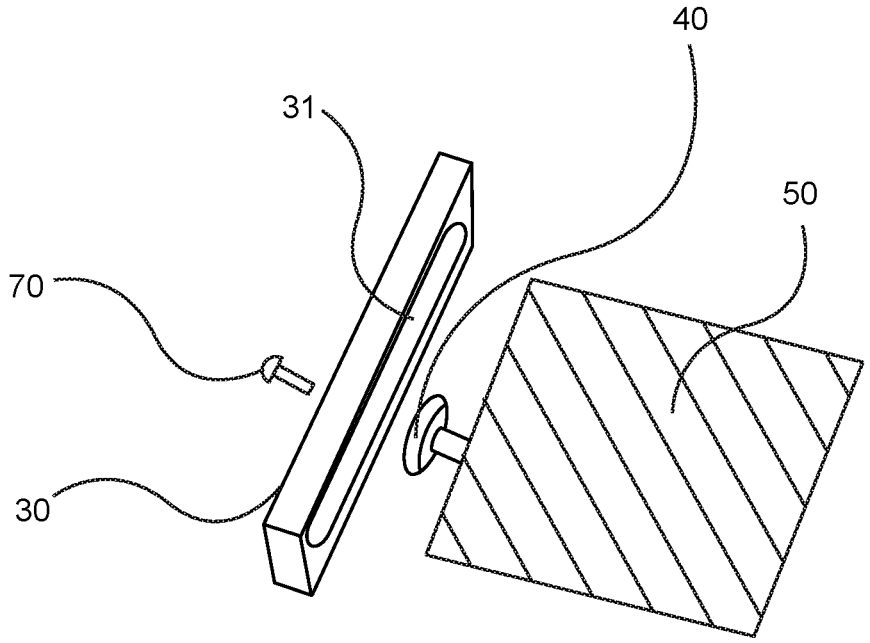
FIG. 5 illustrates an exploded view of bracket 30 and footrest 50.
Figure 6:
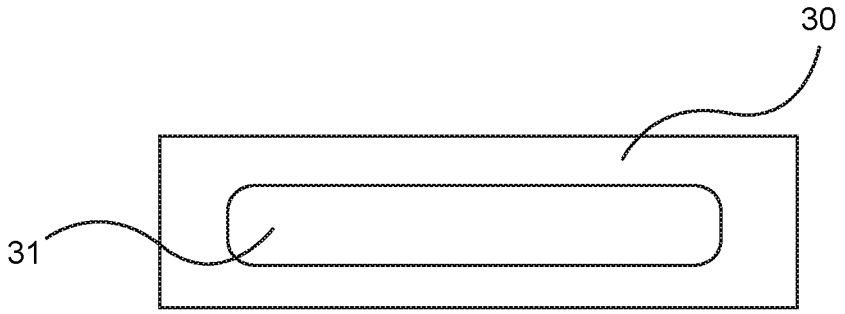
FIG. 6 illustrates a front view of bracket 30.

Referring now to the drawings, FIGS. 1-6, where the present invention is generally referred to with numeral 10, it can be observed that a chair, in accordance with one embodiment, is provided that mainly includes a pair of leg frames 20, a pair of brackets 30, at least a pair of rollers 40, a footrest 50, at least one lever 60, a pair of gliding pins 70 and wheels 80.

Pair of leg frames 20 is provided on respective legs 21 of chair 10. On respective legs 21, pair of leg frames 20 is provided underneath a handle portion 22. In one embodiment, pair of leg frames 20 is made of wooden material. In another embodiment, pair of leg frames 20 can be made of any other material similar to the material of chair 10 like polymeric or metallic materials. Leg frames 20 are provided with a receiving portion (not illustrated in Figures).

Brackets 30 are fixedly fitted along the body of the respective leg frames 20. Each bracket 30 is defined with a railing 31 that is fitted in the corresponding receiving portion of leg frame 20. Typically, brackets 30 are made of aluminum material so as to provide strength to wooden leg frames 20. Alternatively, brackets 30 can be made of any other metallic or polymeric material that can increase the strength of leg frames 20. Although the present disclosure is described with brackets 30 and leg frames 20 as independent components, however, brackets 30 and leg frames 20 can also be integral or a single component.

At least one roller 40 is disposed of in each railing 31 such that each roller 40 rolls along the length of respective railing 31. Typically, rollers 40 can be made of any material like polymeric or metallic or metallic coated with polymeric.

Footrest 50 is positioned centrally and disposed on oppositely positioned rollers 40 and configured to extend and retract upon rolling movement of rollers 40. Size of footrest 50 is more as footrest 50 is of a size equal to sitting area of chair 10 because footrest 50 when in retracted configuration complete occupies the area between four legs of chair 10.

In one embodiment, levers 60 can be optionally provided and connects footrest 50 and a portion under seat 12 of chair 10 and limit the movement of footrest 50 within the limits of rollers 40. Levers 60 can be a single component or can be provided with a connection to achieve a connection. Levers 60 can also have an extended handle (not illustrated in Figures) that when operated enables to easily push and pull footrest 50.

Gliding pin 70 is provided that connects rollers 40 with footrest 50.

Wheels 80 are fitted underneath footrest 50 to support footrest 50 and enable easy movement of footrest 50 along with movement of chair 10.

Chair 10 can be used as a stationary chair or can be portable by attachment of wheels such that a patient who can have recently undergone hip or knee operation can comfortably position their feet on extended footrest 50. A user or a patient more in weight needs more feet positioning space and hence extended footrest 50 of the present disclosure having more surface area provides desired space for comfortably positioning feet. Also, footrest 50 is capable to withstand more weight of user or patient and hence prevents footrest 50 from breaking. Also, assembly of footrest 50 with leg frames 20 provides stability and safety.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A chair comprising:

a) leg frames disposed oppositely with respect to each other and disposed on adjacent legs underneath a handle portion of said chair;

b) brackets, one of said brackets fixedly disposed on each of said leg frames, each of said brackets defined with a railing, said railing extending a partial length of each of said brackets;

c) rollers received within said railings configured to roll within said railings; and d) a footrest for receiving feet of a user, said footrest connected to said rollers, said rollers being in abutting contact with said footrest and extending outwardly and away from said footrest along lateral sides thereof, said footrest configured to extend and retract upon movements of said rollers within said railing, at least one lever connected to and between said footrest and a seating portion of said chair, said at least one lever being entirely below said seating portion and within the leg frames.

2. The chair as claimed in claim 1, said at least one lever configured to limit movement of said footrest and having an extended handle that when operated enables pushing and pulling of said footrest.

3. The chair as claimed in claim 1, further includes a gliding pin for connecting each of said rollers to said footrest.

4. The chair as claimed in claim 3, wherein said gilding pin is perpendicular to said footrest and received by said rollers.

5. The chair as claimed in claim 1, wherein said brackets are made of an aluminum material.

6. The chair as claimed in claim 1, wherein said leg frames are made of a wooden material.

7. The chair as claimed in claim 1, wherein said footrest having an underside portion provided with at least one wheel, additional of said at least one wheel further being mounted to said legs, said at least one wheel being entirely underneath of said legs.

* * * * *